United States Patent [19]

Bandukwalla

[11] Patent Number: 4,830,575

[45] Date of Patent: May 16, 1989

[54] SPIRAL GROOVES IN A TURBINE ROTOR

[75] Inventor: Phiroze Bandukwalla, Olean, N.Y.

[73] Assignee: Dresser-Rand Company, Corning, N.Y.

[21] Appl. No.: 153,590

[22] Filed: Feb. 8, 1988

[51] Int. Cl.[4] ..... F01D 5/18

[52] U.S. Cl. ..... 416/95; 416/174; 416/193 A; 415/173.7; 415/174.4

[58] Field of Search ..... 416/174 A, 193 A, 95, 416/96 R; 415/172 A, 98, 174

[56] References Cited

U.S. PATENT DOCUMENTS

| | | | |
|---|---|---|---|
| 2,336,323 | 12/1943 | Warren | 415/172 A |
| 2,648,519 | 8/1953 | Campini . | |
| 2,675,672 | 4/1954 | Schörner | 416/95 X |
| 2,857,132 | 10/1958 | McDowell | 416/217 X |
| 2,915,279 | 12/1959 | Chamberlin | 416/95 X |
| 2,988,325 | 6/1961 | Dawson . | |
| 2,996,279 | 8/1961 | Lorett et al. . | |
| 3,437,313 | 4/1969 | Moore . | |
| 3,609,057 | 9/1971 | Radtke | 415/115 X |
| 3,623,736 | 11/1971 | Petrie | 415/172 A X |
| 3,635,586 | 1/1972 | Kent et al. | 416/97 R |
| 3,719,431 | 3/1973 | Steele et al. | 416/193 A X |
| 3,989,412 | 11/1976 | Mukherjee | 416/97 R |
| 4,218,189 | 8/1980 | Pask | 416/174 A |
| 4,265,590 | 5/1981 | Davies | 416/95 |
| 4,302,148 | 11/1981 | Tubbs | 415/115 |
| 4,348,157 | 9/1982 | Campbell et al. | 415/115 X |
| 4,415,309 | 11/1983 | Atterbury | 416/174 A X |

FOREIGN PATENT DOCUMENTS

| | | | |
|---|---|---|---|
| 204382 | 7/1956 | Australia | 416/193 A |
| 477373 | 6/1929 | Fed. Rep. of Germany | 416/95 |
| 243684 | 1/1947 | Switzerland | 416/95 |
| 653267 | 5/1951 | United Kingdom | 416/193 A |
| 809268 | 2/1959 | United Kingdom | 416/193 A |
| 1364511 | 8/1974 | United Kingdom | 415/172 A |

*Primary Examiner*—Everette A. Powell, Jr.

[57] ABSTRACT

A spiral groove machined in the end face of a turbine rotor disc accelerates boundary layer fluid flow from the interior of the turbine rotor to the compression chamber. This flow cools the rotor disc and vanes. A transverse axial passageway may be provided beneath the vane roots. Radial extensions from this transverse passageway act to divert cool air through the rotor vanes. Abradable rings may be provided to the stator assemblies adjacent the spiral grooves which act to minimize wear between the sharp edges of the spiral grooves and the stator assemblies.

14 Claims, 2 Drawing Sheets

SPIRAL GROOVES IN A TURBINE ROTOR

FIELD OF THE INVENTION

This invention pertains to cooling means for turbine rotors and more particularly to spiraled grooves formed on the end faces of a turbine rotor. Transverse passages between the spiraled grooves may be provided, which communicate with radially disposed rotor blade cooling passages.

SUMMARY OF THE INVENTION

Spiral grooving of rotor discs in turbo machinery has several advantages over prior art un-grooved or concentric groove designs. The high velocities in the thin boundary layers adjacent the grooves provide a very good heat transfer medium. Spiral grooving provides low radial velocities and low static pressure gradients which prevent flow from tripping over the grooves. Thus turbulence and pertubations to the main flow are minimized. The ridges created by the grooves increase the surface area like fins, and thereby dissipate heat from the rotor. Since the fins may rub against abradable stator parts without jamming or generating excessive heat, low axial gap clearances are possible. Low clearances prevent excessive gas leakage, improve engine performance and increase rotor life. The ridges may be an intentional by-product of the turning operation required for rotor disc manufacture and may actually eliminate a final or additional finishing operations. Thus, it is foreseen that rotors with spiral grooves would be less expensive to manufacture than rotors without spiral grooves. The grooves also make the discs stiffer, thereby minimizing disc vibration without adding substantial weight. spiral grooves eliminate costly axial seals in turbine rotors, thereby reducing assembly time and minimizing the number of parts. An additional benefit of the spiral groove method of cooling is the energization of the end wall boundary layer in both the rotor and the stator. Contrary to the standard method of providing blade twisting near the blade root to accommodate boundary layer flow, the present invention energizes the boundary layer rather than accommodates it. This gives both higher efficiency and range.

Accordingly, a turbine is provided comprising at least one rotor disc and two or more stators. The rotor disc consists of two opposing ends faces and an exterior surface from which the rotor blades protrude into the turbine chamber. The stators include stator vane support rings. The improvements of the present invention include the provision of a first spiral groove formed on a first end face of the rotor disc. In addition, a stator support ring may be provided with a ring formed of abradable material and located adjacent the first spiral groove. A second spiral groove may be provided on the second end face of the rotor disc and likewise, and second ring of abradable material may be provided adjacent the second spiral groove. Further improvements are realized when a transverse axial passageway is provided between the first and second spiral grooves. A plurality of radial extending passages cooperate between the transverse passage and pass through the rotor blades. Concentric grooves radially outward from the first spiral groove and an associated wear pattern in the abradable material cooperate in the diversion of flow from the first spiral groove into the transverse passages.

DESCRIPTION OF THE PREFERRED EMBODIMENT

Figure 1:
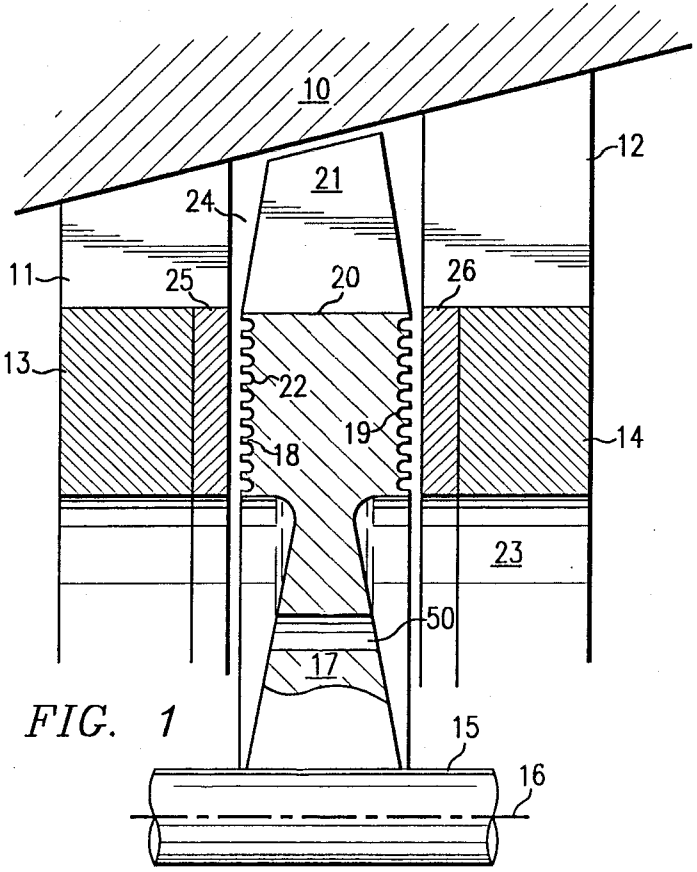
FIG. 1 is a cross section of the present invention where similar spiral grooves are provided on both end faces of a turbine rotor.

As shown in FIG. 1, a turbine incorporating the improvements of the present invention includes a turbine casing 10 having first stage stator vanes 11 and second stage stator vanes 12. The first stage stator vanes are commonly joined at a first stage vane support ring 13. The second stage stator vanes are commonly joined at a second stage vane support ring 14. For reference purposes displacement from the first stage stator to the second is referred to as axially inward. The turbine includes a shaft 15 which rotates about a central axis 16. A rotor disc 17 is mounted on the central shaft 15. The rotor disc 17 is characterized by a first end face 18, a second end face 19 and an exterior surface 20 from which integral rotor blades 21 protrude. For reference purposes, displacement from the central axis to the casing is defined as radially outward. A continuous spiral groove 22 is formed on the first end face. The spiral groove accelerates boundary layer fluid flow and transports it from the interior 23 of the turbine to the working turbine area 24. The width to depth ratio of the groove is about 1:1. Compressed air is introduced into the interior 23 from outside source, for example a compressor. It is allowed to flow from one side of the disk 17 to the other side via through ports 50. Because of the small clearance between the rotor disc and the stator vane support rings, abrasive rings 25, 26 are interposed between each of the spiral grooves and the adjacent stator support rings. The abradable rings may be fabricated from Honeycomb Hastelloy X manufactured by Cabot Corp. Kokomo, Ind., as per ASM 5536. The pointed ridges which separate adjacent channels in the spiral groove may be a by-product of the turning operation. Sharp ridges are preferable because they simplify manufacturing. Even if they wear down, they will not be completely wiped off. If centrifugal force bends them over, they become more efficient in preventing hot gas from leaking and cool gas from dispersing.

Figure 2:
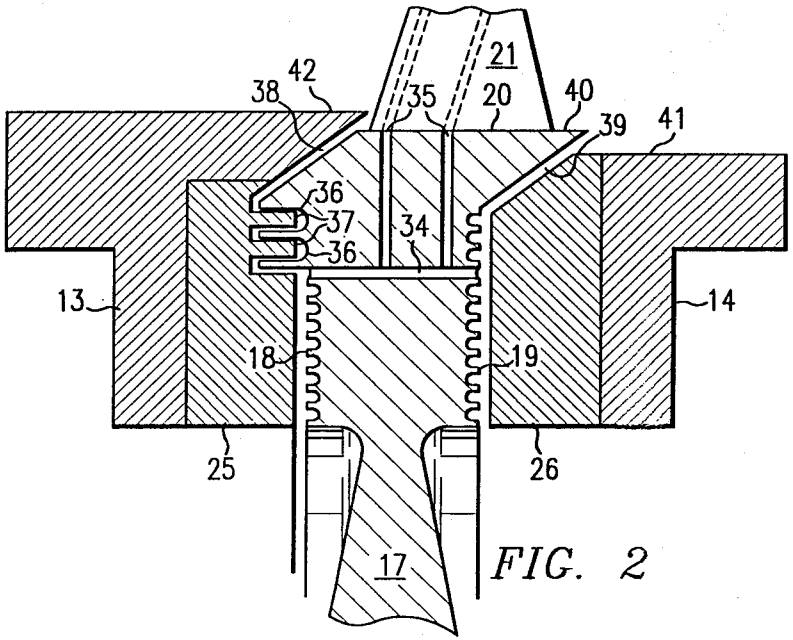
FIG. 2 is a cross section of the present invention where a rotor has been provided with concentric grooves, spiral grooves and a transverse cooling passageway having radial extensions which pass through the blades.

As seen in FIG. 2, the rotor disc may further incorporate transverse axial passages 34 between the end faces of the rotor disc. One passage 34 per rotor blade is required. Branching out from this transverse axial passageway 34, one or more radially disposed extensions 35 pass through the blade and communicate with the turbine chamber 24. Thus, cool air from the compressor is urged towards the chamber 24 and enters the transverse passage under the blade roots. Cool air from the compressor thus cools the end faces, the surface of the rotor vanes and the blade roots. This process is aided with the provision of one or more concentric grooves 36 located radially outwardly of the spiral groove. As shown in FIG. 2, a wear pattern 37 consisting of concentric ridges in the abradable material conforms to the concentric grooves 36. The matching grooves and wear pattern provide a seal although not a complete seal. Thus the concentric restrictions act to force flow from along the first end face 18 into the transverse passage 34. Some flow does however enter the concentric grooves and is ejected through a slanted annulus 38. The flow which emerges from the slanted annulus 38 energizes the boundary layer flow in the turbine compartment 24 and acts as a thermal barrier at the rotor surface 20. Notice that this flow as it exits the annulus 38 is directed by a lip 42 which extends radially outward of the rotor surface 20 and axially inward of the first rotor face 18.

Compressed air entering the spiral groove in the second end face 19 proceeds upwardly and combines with the air exiting the transverse passage 34. The combined flow travels through the second slanted annulus 39 into the turbine chamber 24. It is directed, by an axially inwardly and radially outwardly protruding lip 40 formed on the rotor disc, towards the inner diameter 41 of the second stage stator support ring 14.

While we have described above the principles of the invention in connection with specific equipment, it will be appreciated by those with ordinary skill in the art that the above description is made only by way of example and not as a limitation to the scope of the invention as set forth in the accompanying claims.

What is claimed is:

1. In a turbine system comprising two or more stators and a rotor disc having an exterior surface and opposing end faces, the improvement comprising:

a first single continuous spiral groove formed on a first end face of the rotor disc; and the first stator comprising a vane support ring, the vane support ring having attached thereto a first ring formed of an abradable material, the first ring located adjacent the first spiral groove.

2. The improved turbine of claim 1, wherein:

a second spiral groove is provided on a second end face of the rotor disc.

3. The improved turbine of claim 2, wherein:

a second stator includes a second vane support ring having attached thereto a second ring formed of abradable material, the second ring located adjacent the second spiral groove.

4. The improved turbine of claim 3, wherein:

the rotor disc further comprises one or more concentric grooves located radially outwardly of the first spiral groove;

the first abradable ring comprising concentric ridges which cooperate with the concentric grooves on the first end face; and whereby a transverse axially disposed passage is formed between the first and second spiral grooves.

5. The improved turbine of claim 4, wherein:

the transverse passage further comprises one or more radial extensions.

6. The improved turbine of claim 4 further comprising a first slanted annular passage formed between the first end face and the first abradable ring.

7. The improved turbine of claim 6 further comprising a lip formed on the first ring adjacent the first annular passage, said lip projecting radially outward of the rotor surface and axially inward of the first end face.

8. The improved turbine of claim 7 further comprising a second annular passage located between the second and face and the second abradable ring.

9. The improved turbine of claim 8 further comprising a lip formed on the rotor surface adjacent the second annular passage, said lip projecting radially outward of the inner diameter of the stator and axially inward of the second end face.

10. In a turbine system comprising two or more stators the stators each having a stator support ring from which stator blades outwardly project; and a rotor disc having an exterior surface and opposing end faces, the improvement comprising:

a first single continuous spiral groove formed on a first end face of the rotor disc;

one or more concentric grooves located radially outward of the first spiral groove on the first end face;

a second spiral groove formed on a second end face of the rotor disc;

a first stator comprising a first stator support ring having a first abradable ring attached thereto, the first abradable ring adjacent the first spiral groove;

a second stator comprising a second stator support ring having a second abradable ring attached thereto, the second abradable ring adjacent the second spiral groove;

the first abradable ring having at least one concentric ridge cooperating with at least one concentric groove of the first end face to effectuate a resistance to a radial flow occurring between the first end face and the abradable rings;

a transverse passage leading from a location on the first end face radially outward of the spiral groove and radially inward of any cooperating ring and groove, to a location on the second end face; and the transverse passage having outwardly directed radial extensions.

11. The turbine system improvement of claim 10, wherein:

a first slanted annulus extends radially outward and axially inward of the cooperating concentric groove and ridge, the first slanted annulus defined by the first stator and the rotor disc.

12. The turbine system improvement of claim 11 wherein:

the rotor disc comprises a plurality of blades located axially inward of the first end face; and the first stator support ring further comprises a first lip which extends radially outward of the exterior surface of the rotor and axially inward to the first spiral groove.

13. The turbine system improvement of claim 11, wherein:

a second slanted annulus extends radially outward and axially inward of the second spiral groove, the second slanted annulus defined by the rotor and the second stator.

14. The turbine system improvement of claim 13, wherein:

the second stator support ring further comprises an outer diameter; and the rotor disc further comprises a second lip, the lip extending axially inward of the second spiral groove and radially outward of the outer diameter of the stator support ring.

* * * * *